US005928761A

United States Patent [19]

Hedblom et al.

[11] Patent Number: 5,928,761

[45] Date of Patent: Jul. 27, 1999

[54] RETROREFLECTIVE BLACK PAVEMENT MARKING ARTICLES

[75] Inventors: Thomas P. Hedblom, Eagan; Gregory F. Jacobs, Woodbury, both of Minn.

[73] Assignee: Minnesota Mining and Manufacturing Company, St. Paul, Minn.

[21] Appl. No.: 08/895,297

[22] Filed: Jul. 16, 1997

[51] Int. Cl.[6] ..... G08B 9/06

[52] U.S. Cl. ..... 428/143; 428/149; 428/325; 428/195; 428/323; 428/201; 428/204; 428/206; 428/207; 428/156; 359/540; 404/14; 404/12

[58] Field of Search ..... 428/143, 149, 428/325, 195, 323, 201, 204, 206, 207, 156; 359/540; 404/14, 12

[56] References Cited

U.S. PATENT DOCUMENTS

| | | | |
|---|---|---|---|
| 2,379,741 | 7/1945 | Palmquist | 88/82 |
| 2,407,680 | 9/1946 | Palmquist et al. | 88/82 |
| 2,567,233 | 9/1951 | Palmquist et al. | 88/82 |
| 2,592,882 | 4/1952 | Fisher et al. | 88/82 |
| 3,172,942 | 3/1965 | Berg | 88/82 |
| 3,758,192 | 9/1973 | Bingham | 350/105 |
| 3,877,786 | 4/1975 | Booras et al. | 350/105 |
| 3,891,451 | 6/1975 | Okazaki | 106/30 |
| 4,040,760 | 8/1977 | Wyckoff | 404/14 |
| 4,714,656 | 12/1987 | Bradshaw et al. | 428/916 |
| 5,108,218 | 4/1992 | Wyckoff | 404/14 |
| 5,338,595 | 8/1994 | Li | 428/143 |
| 5,344,705 | 9/1994 | Olsen | 428/323 |
| 5,451,447 | 9/1995 | Li | 428/143 |
| 5,593,246 | 1/1997 | Hedblom et al. | 404/9 |
| 5,676,488 | 10/1997 | Hedblom | 404/9 |

FOREIGN PATENT DOCUMENTS

| | | | |
|---|---|---|---|
| 0 304 405 | 2/1989 | European Pat. Off. . | |
| 0 358 384 | 3/1990 | European Pat. Off. . | |
| 0 488 526 | 6/1992 | European Pat. Off. . | |
| 0 512 668 | 11/1992 | European Pat. Off. | G02B 5/128 |
| 469 779 | 4/1969 | Switzerland . | |
| 670473 | 4/1952 | United Kingdom . | |
| WO93/17188 | 9/1993 | WIPO . | |
| WO96/16231 | 5/1996 | WIPO . | |

*Primary Examiner*—William P. Watkins, III
*Attorney, Agent, or Firm*—Lisa M. Fagan

[57] ABSTRACT

The articles of the present invention comprise optical elements embedded in either a core having a binder layer which is embedded in a road-binder or optical elements which are directly embedded into a binder layer. The binder layer may be part of a preformed pavement marking tape or may be applied directly to a traffic-bearing surface. The binder layer is comprised of a black pigment. The pavement marking articles of the present invention comprise one or more first region(s) wherein the first region(s) has a daytime appearance of black and is retroreflective.

In another embodiment of the present invention, the pavement marking articles further comprise one or more second region(s) having a color which contrasts with black during the daytime and which is typically also retroreflective. The second region(s) is adjacent to the first region(s).

28 Claims, 3 Drawing Sheets

RETROREFLECTIVE BLACK PAVEMENT MARKING ARTICLES

FIELD OF THE INVENTION

The present invention relates to pavement markings comprising optical elements and/or skid-resistant particles. More particularly, the present invention relates to pavement markings having a portion which retroreflects either white, yellow or another color yet under daylight illumination appears substantially black.

BACKGROUND OF THE INVENTION

The use of pavement markings (e.g., paints, retroreflective elements, tapes, and individually mounted articles) to guide and direct motorists traveling along a roadway is well known. During the daytime the markings may be sufficiently visible under ambient light to effectively signal and guide a motorist. However, the degree of conspicuity or visibility depends in large part on the pavement surface. For example, a white pavement marking on a concrete road may be difficult for the motorist to see because of the lack of contrast.

In addition, at night, especially when the primary source of illumination is the motorist's vehicle headlights, the markings may be insufficient to adequately guide a motorist because the light from the headlight hits the pavement and marking at a very low angle of incidence and the light is not sufficiently reflected back toward the motorist. Thus, improving daytime conspicuity and night time retroreflection is desirable.

Retroreflection describes the mechanism where light incident on a surface is reflected so that much of the incident beam is directed back toward its source. The most common retroreflective pavement markings, such as lane lines on roadways, are made by dropping transparent glass or ceramic microspheres or optical elements onto a freshly painted line such that the optical elements become partially embedded therein. The transparent optical elements each act as a spherical lens and thus, the incident light passes through the optical elements to the base paint or sheet striking pigment particles therein. The pigment particles scatter the light redirecting a portion of the light back into the optical element such that a portion is then redirected back towards the light source.

In addition to providing the desired optical effects, pavement markings must withstand road traffic, adverse weather conditions, and cost constraints.

Pavement marking articles and other substantially horizontal markings typically exhibit high retroreflective brightness when the light is incident at high entrance angles (typically greater than about 85°). Retroreflective sheeting and other retroreflective articles attached to vertical surfaces, on the other hand, tend to exhibit high retroreflective brightness at lower entrance angles (e.g., within 30° to 40° of normal). Thus, the optics of pavement marking articles differ from the optics of retroreflective sheeting.

The retroreflective efficiency of flat pavement marking articles is limited because the exposed surfaces of the optical elements are directed upward, whereas the optimal orientation is toward vehicle headlights which typically illuminate the retroreflective beads from angles slightly above the road surface and because the optical element alignment results in the exposed surface of the optical elements being exposed to maximum abrasive wear by vehicle tires. Pavement marking articles having protrusions have several advantages including, runoff of rain water and availability of locally non-horizontal surfaces to support optical elements.

The need exists for substantially horizontal retroreflective pavement marking articles having enhanced visibility and contrast.

SUMMARY OF THE INVENTION

The present invention provides pavement marking articles which are substantially black under ordinary daytime illumination and which are retroreflective. These substantially horizontal pavement marking articles can be preformed pavement marking tapes, retroreflective elements embedded in a road-binder, or optical elements embedded in a binder layer.

The articles of the present invention comprise optical elements embedded in either a core having a binder layer which is embedded in a road-binder (i.e., material for adhering retroreflective elements to a traffic-bearing surface) or optical elements which are directly embedded into a binder layer. The binder layer may be part of a preformed pavement marking tape or may be applied directly to a traffic-bearing surface. The binder layer is comprised of a black pigment (preferably carbon black). The pavement marking articles of the present invention comprise one or more first region(s) wherein the first region(s) has a daytime appearance of black and is retroreflective.

In another embodiment of the present invention, the pavement marking articles further comprise one or more second region(s) having a color which contrasts with black during the daytime and which is typically also retroreflective. The second region(s) is adjacent to the first region(s). Advantageously, these articles provide enhanced conspicuity during the daytime and enhanced retroreflection at night. The contrast between the first and second regions enhances daytime visibility. Additionally, the area of retroreflectivity of the marking article is enlarged enhancing retroreflectivity and visibility at night.

Typically, the pavement marking articles of the present invention retroreflect white or yellow.

FIGURES

FIG. 1 is a cross-sectional view of the pavement marking article 10 where optical elements 12 are embedded in the binder layer 16.

FIG. 2 is a cross-sectional view of the pavement marking article 10*a* where optical elements 12 are embedded in binder layer 16. The base layer 14 is located between the binder layer 16 and the optional adhesive layer 20 which secures the article to the traffic-bearing surface 18.

FIG. 3 is a plan view of pavement marking article 30 where optical elements 12 and skid-resistant particles 19 are embedded in the binder layers 16 and 17 of first regions 32 and second region 34.

FIG. 3*a* is a cross-sectional view of pavement marking article 30 on a traffic-bearing surface 18 where optical elements 12 are embedded in binder layers 16 and 17 of first regions 32 and second region 34.

FIG. 4 is a top plan view of pavement marking article 40 on a traffic bearing surface 18 where first region 32 is longitudinally adjacent to second region 34.

FIG. 5 is a cross-sectional view of pavement marking article 50 on a traffic-bearing surface 18, where optical elements 12 are embedded in binder layer 16.

FIG. 6 is a cross-sectional view of pavement marking article 60 on a traffic-bearing surface 18, where optical elements 12 are embedded in a binder layer 16 to form a retroreflective element 62 which is embedded in road-binder 26.

The figures, which are idealized and not to scale, are intended to be merely illustrative and non-limiting.

DETAILED DESCRIPTION OF ILLUSTRATIVE EMBODIMENTS

The present invention provides a pavement marking article comprising one or more first regions having a daytime appearance of black while being retroreflective. A pavement marking article is attached to the surface of a road or other traffic-bearing surface. Types of roads include asphalt, concrete, etc.

The pavement marking articles of the present invention generally have an optical system comprising transparent microspheres (i.e., optical elements) partially embedded in a binder layer containing black pigment (e.g., carbon black). The pavement marking articles of the present invention may be in the form of preformed tapes, typically further comprising a conformance layer and/or adhesive layer on one surface of the binder layer. The pavement marking articles of the present invention may also be formed directly on the roadway. For example, the binder layer may be applied to the surface of the roadway and then optical elements may be applied or partially embedded therein or retroreflective elements comprising a binder layer and optical elements may be partially embedded in a road-binder.

The second region(s) may be made by using tinted optical elements in combination with a binder layer containing a light scattering or reflecting pigment such as titanium dioxide.

A preferred embodiment of the present invention is a pavement marking article which further comprises one or more second regions. The first region(s) is adjacent to the second region(s). However, the second region(s) has a color which contrasts with black. "Black" is defined herein as having a low luminance factor and being substantially achromatic or as preferably having a Y value of about 20 or less, preferably about 15 or less, and more preferably about 10 or less. Contrasting colors include, but are not limited to, white, yellow, orange, etc. Contrasting colors may be fluorescent if desired.

Generally, the second region(s) comprise optical elements partially embedded in a binder layer.

Figure 1:
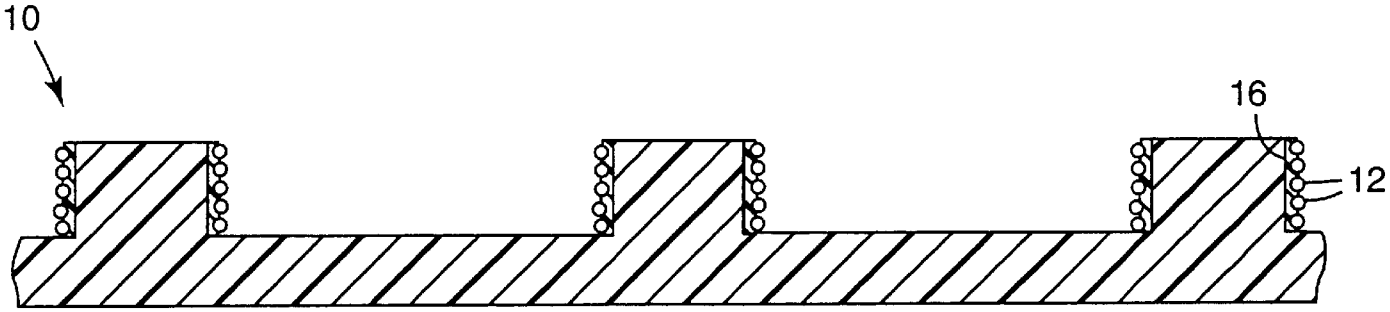
Figure 2:
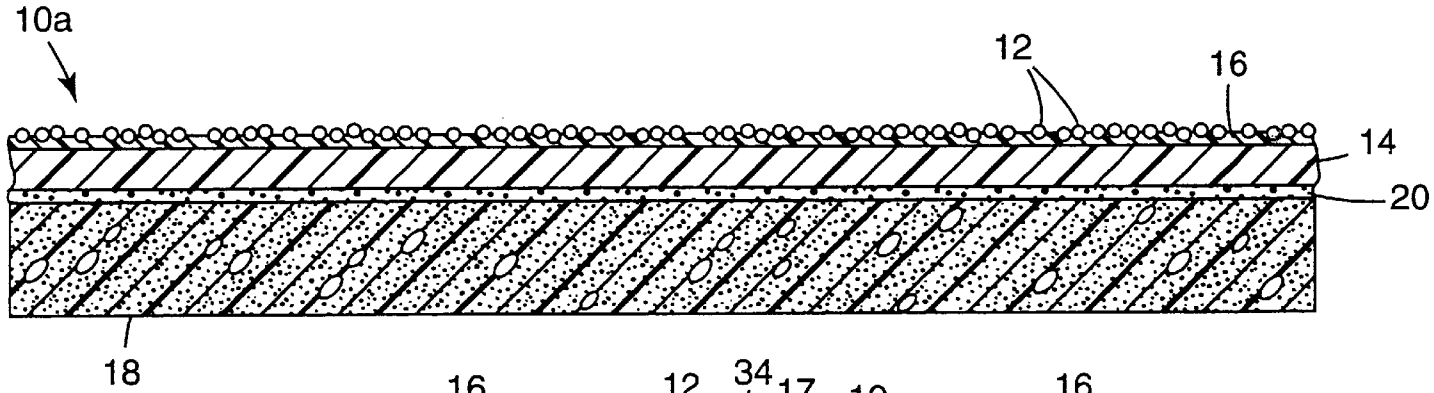
Figure 3:
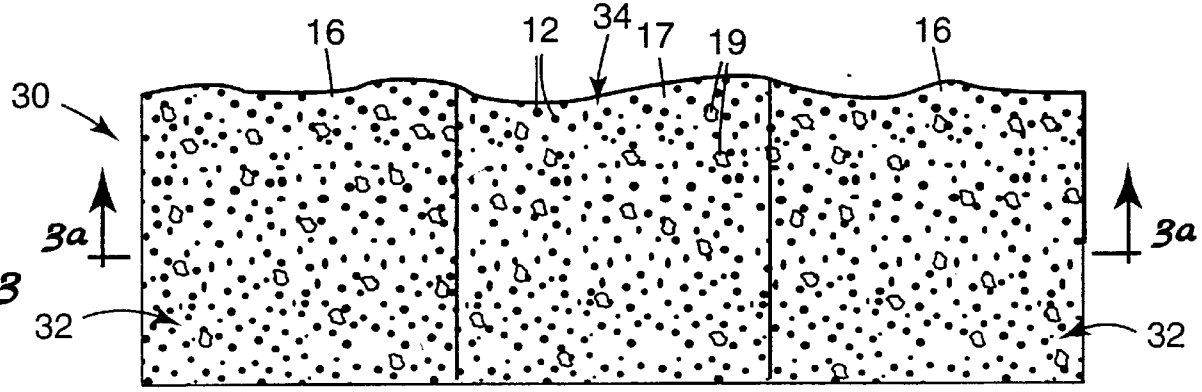
Figure 4:
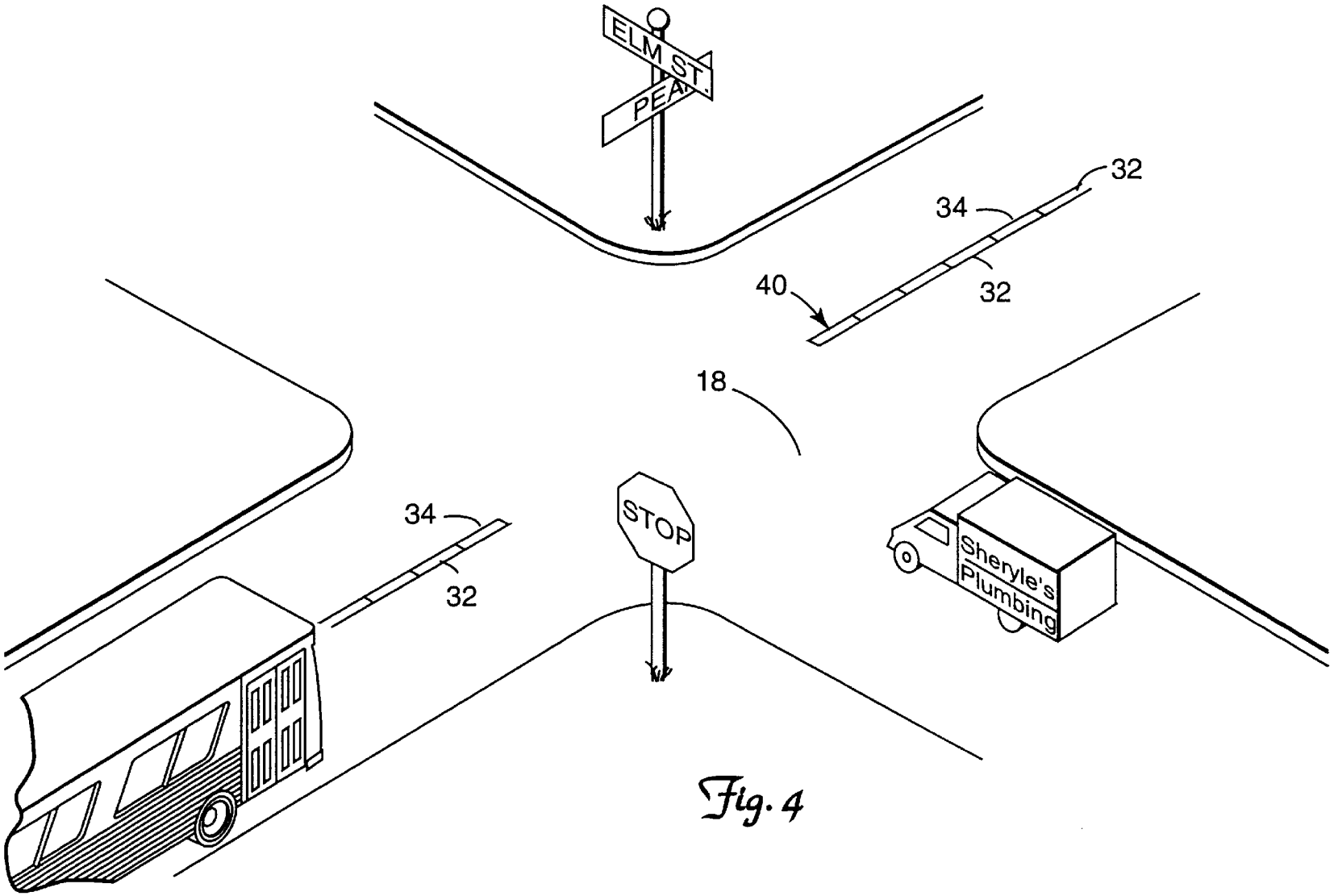
Figure 3A:
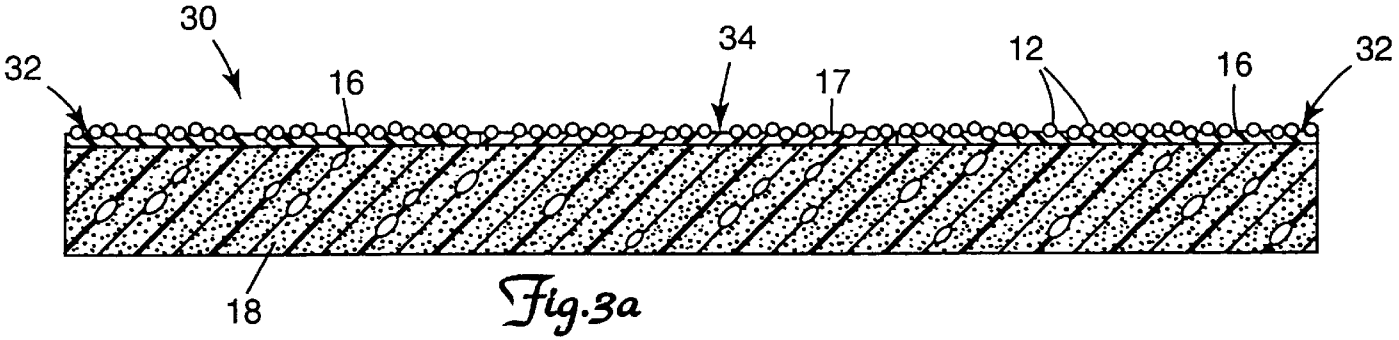
Figure 5:
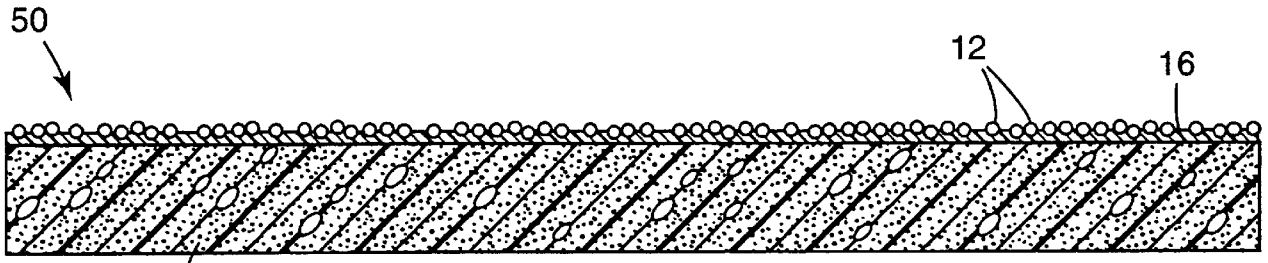
Figure 6:
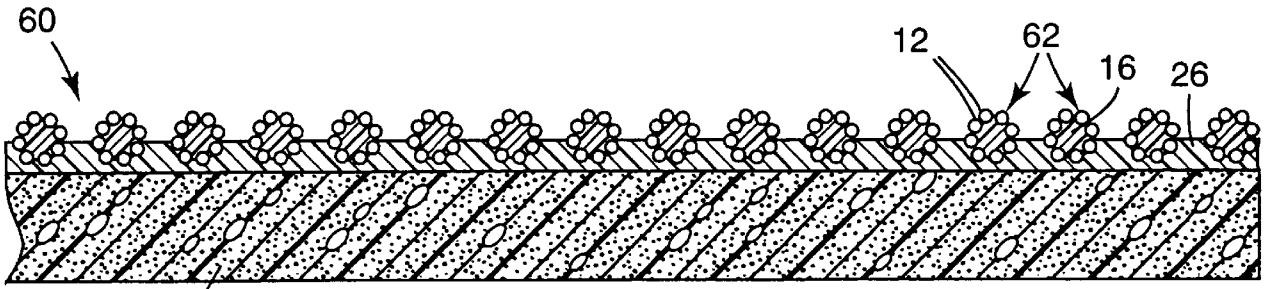

The second region(s) is adjacent to the first region(s). However, the regions do not need to share a border (i.e., there may be a small space between the regions) and the regions may overlap. The second region(s) may be adjacently oriented relative to the first region such that the second region is laterally adjacent to the first region (i.e., across the road surface width or transversely adjacent to the direction of the driver). (See FIG. 3.) Alternatively, the second region may be oriented such that it longitudinally alternates with the first region as a traveler progresses along the road length. (See FIG. 4.) The first type of orientation may provide enhanced conspicuity on concrete road surfaces as well as on "bleached" asphalt road surfaces (i.e., asphalt surfaces lightened by the sun, commonly found on roads in the southern part of the United States). With this first orientation, the pavement marking article has a larger area of retroreflection across the width of the marking. For example, the width of available retroreflective surface may increase from 4 inches (100 mm) to 7 inches (180 mm).

The second type of orientation also may enhance visibility or conspicuity of the pavement marking, particularly on concrete or "bleached" asphalt road surfaces. The retroreflectivity of the pavement marking article may also be enhanced because a longer line or a continuous line of the roadway may be retroreflective. The retroreflected color may vary depending on the type of optical element embedded in each region as well as the light-reflecting system of the binder layer of each region.

Binder Material

The binder layer in the first region(s) is comprised of a binder material, black pigment (e.g., carbon black), light-reflecting system, optical elements, and optional skid-resistant particles. Typically, the binder material is a polymeric material. The polymeric material, at least in the areas surrounding the embedded portions of the optical elements, preferably is sufficiently light transmissive such that incident light refracted by the optical elements can pass through the binder material to interact with the dispersed pigment particles. Many useful polymeric materials for use in the binder layers of the pavement marking articles are well known and a suitable one for use in a particular embodiment of the present invention can be readily selected by one skilled in the art. Illustrative examples of suitable polymeric materials include thermoset materials and thermoplastic materials. Suitable polymeric material includes, but is not limited to, urethanes, epoxies, alkyds, acrylics, acid olefin copolymers such as ethylene/methacrylic acid, polyvinyl chloride/polyvinyl acetate copolymers, etc.

The binder material in the first region(s) is comprised of black pigment, preferably carbon black. Generally, the black pigment is added at about 1 weight percent or greater. The particle size of the black pigment generally ranges from about 0.01 micron to about 0.08 micron. The ratio of the light-reflecting system to the black pigment ranges from about 7:1 to about 80:1; preferably the ratio ranges from about 7:1 to about 27:1 by weight.

The binder material also comprises a light-reflecting system. The light-reflecting system may comprise either a specular pigment or a diffuse pigment. Preferably, the light-reflecting system is a specular pigment such as a pearlescent pigment. Illustrative examples of pearlescent pigments include, but are not limited to AFFLAIR 9103 and 9119 (obtained from EM Industries Inc., New York), Mearlin Fine Pearl #139V and Bright Silver #139Z (obtained from The Mearl Corporation, Briarcliff Manor, N.Y.). Typically, if the light-reflecting system comprises pearlescent pigment, the pearlescent pigment is present at about 10% to about 30% by volume or about 20% to about 45% by weight, more preferably between about 30% and about 40% by weight, and most preferably at about 35% by weight.

Illustrative examples of diffuse pigments include, but are not limited to, titanium dioxide, zinc oxide, zinc sulfide, lithophone, zirconium silicate, zirconium oxide, natural and synthetic barium sulfates, and combinations thereof. Typically, if the light-reflecting system comprises diffuse pigment, the diffuse pigment is present at about 5% to about 15% by volume.

Vapor coated (e.g., with aluminum) optical elements may also be used with black pigment. When vapor coated optical elements are used, the light-reflecting system is optional in the binder. See U.S. Pat. No. 2,963,378 (Palmquist et al.), incorporated by reference herein, for a description of vapor coated optical elements. The coefficient of retroreflection measured at an entrance angle of −4.0 degrees and an observation angle of 0.2 degrees typically ranges from 80 to 100 cd/lx/m$^2$ for aluminum vapor coated optical elements.

The binder material may comprise colorants in the second region(s). Illustrative samples of common colorants include white, yellow, and red, although other colorants may be used as desired. Examples of suitable colorants include, but are not limited to Titanium Dioxide CI 77891 Pigment White 6 (DuPont, Wilmington, Del.), Chrome Yellow CI 77603 Pigment Yellow 34 (Cookson, Pigments, Newark, N.J.), Arylide Yellow CI 11741 Pigment Yellow 74 (Hoechst Celanese, Charlotte, N.C.), Arylide Yellow CI 11740 Pigment Yellow 65 (Hoechst Celanese, Charlotte, N.C.), Diarylide Yellow HR CI 21108 Pigment Yellow 83 (Hoechst Celanese, Charlotte, N.C.), and Naphthol Red CI 12475 Pigment Red 170 (Hoechst Celanese, Charlotte, N.C.).

The binder layer thickness varies with product usage and wear requirements. The binder layer thickness is sufficient to provide adequate mechanical anchorage to the optical elements and sufficient embedment to enable retroreflection.

The binder layer material preferably has good resistance to contaminants on the road and weathering, good abrasion-resistance, and the ability to firmly hold embedded optical elements and optional skid-resistant particles.

Preformed Pavement Marking Tapes

If desired, preformed pavement marking tapes may further comprise additional layers beneath the binder layer to improve the performance of the resultant pavement marking tape. For example, a base layer (e.g., a conformance layer) and/or adhesive layer may be provided. Many useful examples of such layers of pavement marking tapes are well known and selection of suitable choices for particular embodiments of the invention may be readily made by one with ordinary skill in the art. Examples of suitable base layers include, but are not limited to, those disclosed in U.S. Pat. Nos. 4,117,192; 4,490,432; 5,114,193; 5,316,406; and 5,643,655. Suitable adhesives include, but are not limited to, pressure-sensitive adhesives, rubber resin adhesives, neoprene contact adhesives, etc.

Pavement marking tapes of the present invention may be substantially flat or have protrusions. The binder layer is modified as described herein. Illustrative examples of substantially flat pavement marking tapes include, but are not limited to, U.S. Pat. Nos. 4,117,192; 4,248,932; and 5,643,655.

The top surface of the tape can have protrusions which are selectively coated with a binder layer comprising a black pigment (e.g. carbon black) in a first region, and/or another desired colorant in a second region, and a light-reflecting system. Optical elements and optionally skid-resistant particles are partially embedded in this binder layer. Illustrative examples of tapes having protrusions include, but are not limited to U.S. Pat. Nos. 4,388,359, 4,988,555, 5,557,461, 4,969,713, 5,139,590, 5,087,148, 5,108,218, and 4,681,401. A preferred pavement marking tape having protrusions is disclosed in European Patent Application No. 95 107696.7, filed May 19, 1995.

The pavement marking articles of the present invention can also be preformed magnetic pavement marking tapes. These magnetic tapes can be substantially invisible to the eye during the day (e.g., along the edge lines of a roadway and centerline). Alternatively, these magnetic tapes may comprise second regions having a color which contrasts with black and these tapes can be used as the edge line or center line on a roadway. A preferred embodiment of the magnetic pavement marking tape is a tape comprising a conformance layer having at least 30 volume percent of magnetic particles distributed therein.

The tapes may also be removable for short-term usage.

Retroreflective Elements in a Binder

In another embodiment, the pavement marking article of the present invention is a retroreflective element comprising a core having a plurality of optical elements embedded in a binder layer on the core. The core is then partially embedded in a road-binder. The core comprises a binder layer having black pigment (e.g., carbon black) and a light-reflecting system. Skid-resistant particles may also be embedded in the binder layer. Illustrative examples of retroreflective elements include, but are not limited to, U.S. Ser. No. 08/503,532, filed Jul. 18, 1995; U.S. Ser. No. 08/591,570, filed Feb. 5, 1996; U.S. Ser. No. 08/591,569, filed Feb. 5, 1996. The road-binder can also comprise a black pigment.

Optical Elements in Binder Layer Directly on Road Surface

Another embodiment of the present invention is optical elements partially embedded in a binder layer which is applied directly to a road surface.

Composite Articles

The pavement marking articles of the present invention include composites. Examples of composites include, but are not limited to, flat tape adjacent to tape having protrusions; flat or protrusion tape adjacent to paint or a binder layer having embedded optical elements; tapes in combination with retroreflective elements, etc. One illustrative embodiment is to add a pavement marking tape to an existing line to form a composite.

Optical Elements

A wide variety of optical elements may be employed in the present invention. Typically, for optimal retroreflective effect, the optical elements have a refractive index of about 1.5 to about 2.6.

For pavement marking tape embodiments, the optical elements preferably have a diameter compatible with the size and shape of the protuberances or with the thickness or the top layer (i.e., the binder layer). For the embodiments where the optical elements are embedded in a binder such as paint, the optical elements preferably have a diameter compatible with the binder thickness. Generally, optical elements of about 50 to about 1000 micrometers in diameter may be suitably employed.

The optical elements comprise an amorphous phase, a crystalline phase, or a combination, as desired. The optical elements preferably are comprised of inorganic materials that are not readily susceptible to abrasion. Suitable optical elements include microspheres formed of glass, preferably having indices of refraction of from about 1.5 to about 2.3. Commonly used optical elements are made of soda-lime-silicate glasses.

Microcrystalline ceramic optical elements as disclosed in U.S. Pat. Nos. 3,709,706; 4,166,147; 4,564,556; 4,758,469; and 4,772,511 have higher refractive indexes and enhanced durability. Preferred ceramic optical elements are disclosed in U.S. Pat. Nos. 4,564,556 and 4,758,469. These optical elements are resistant to scratching and chipping, are relatively hard (above 700 Knoop hardness), and are made of to have a relatively high index of refraction. The optical elements may comprise zirconia, alumina, silica, titania, and mixtures thereof.

The optical elements can be colored to retroreflect a variety of colors. Techniques to prepare colored ceramic optical elements that can be used herein are described in U.S. Pat. No. 4,564,556. Colorants such as ferric nitrate (for red or orange) may be added in an amount of about 1 to about 5 weight percent of the total metal oxide present. Color may also be imparted by the interaction of two colorless compounds under certain processing conditions (e.g., $TiO_2$ and $ZrO_2$ may interact to produce a yellow color). The optical elements may be colored so that, for example, colorless, yellow, orange, or some other color of light is retroreflected at night.

Skid-Resistant Particles

Typically a retroreflective preformed pavement marking tape also comprises skid-resistant particles. Illustrative examples of particularly useful skid-resistant particles include those disclosed in U.S. Pat. Nos. 5,124,178; 5,094,902; 4,937,127; and 5,053,253. Skid-resistant particles may also be embedded in a retroreflective element, or embedded in a road-binder.

Generally, skid-resistant particles are randomly sprinkled and become embedded in the binder material while it is in a softened state.

Methods of Manufacture

The articles of the present invention can be made using conventional methods known in the art, modified by selection of materials as described herein.

Methods of Application

Binders layers for pavement marking articles are well-known in the art, particularly for preformed pavement marking tapes and optical elements embedded in a binder layer on a road. Typically, optical elements and skid-resistant particles are sprinkled or otherwise applied to a binder layer material while it is in a liquid state. The elements or particles become partially embedded in the binder layer material while it is liquid. The binder layer material subsequently becomes solid resulting in elements and/or particles partially embedded therein.

The preformed pavement marking tape articles of the present invention may be installed on a roadway or other location using any one of a variety of apparatus such as human pushable dispensers, "behind a truck" types of dispensers, and "built into a truck" type dispensers. U.S. Pat. No. 4,030,958 (Stenemann) discloses a suitable behind a truck type dispenser for applying the articles of the invention in the form of adhesive-backed tapes to a surface.

Other means may be used to install the pavement marking tape articles of the invention, such as simple manual application, or use of the previously mentioned mechanical fasteners.

EXAMPLES

The invention will be further explained by the following illustrative examples, wherein all parts and percentages are by weight, unless otherwise specified.

Retroreflective Brightness Measurements

The coefficient of retroreflection ($R_A$), in cd/Lux/m$^2$, following Procedure B of ASTM Standard E 809-94a, was measured at an entrance angle of −4.0 degrees and an observation angle of 0.2 degrees. The photometer used for those measurements is described in U.S. Defensive Publication No. T987,003.

The coefficient of retroreflective luminance ($R_L$), in mcd/m$^2$/Lx, following ASTM D4061-94, was measured keeping the presentation angle constant at 0 degrees and the orientation angle constant at −180 degrees. The intrinsic geometry as described in ASTM E 808-94 was used. The $R_L$ was measured at a range of entrance angles and observation angles corresponding to different observation distances for a driver.

When evaluating different optical systems for pavement marking tapes having protrusions, it is much easier to simply make a flat pavement marking tape sample of the light-reflecting system of choice with a flood coating of optical elements embedded to about 50 percent of their diameter. Trying to make small samples of pavement marking tapes having protrusions with the same light-reflecting and optical element system secured selectively onto the protrusions is much more time consuming. In addition, the variability between each light-reflecting/optical element system is much greater. When flat pavement marking tape samples are made and the $R_A$ is measured at −4.0/0.2 and is compared to pavement marking tapes having protrusions using the same light-reflecting/optical element system and the $R_L$ measured at a geometry that approximates 80 meters (89.5/0.39), an excellent correlation is obtained. Correlation coefficients of greater than 0.99 have been obtained over a range of $R_A$ from 4 to 400 cd/lx/m$^2$.

Color Measurements

Y is a calorimetric measurement of the sheeting's whiteness. Y values were measured using a Hunter Spectrophotometer (Hunter Miniscan XE, available from Hunter Associates Laboratory, Inc., Reston, Va.), according to ASTM E 97-77 using illuminant D65 and a 2° 1931 CIE Standard Observer.

EXAMPLE 1

Comparative Aluminum Flake Samples

The following polyurethane formulas were made by mixing DESMODUR N-100 aliphatic polyisocyanate, (obtained from the Bayer Corp., Pittsburgh, Pa.), with TONE 0301 polyol, (obtained from Union Carbide Corp., Houston, Tex.), with ATA 5100 aluminum flake, (obtained from Alcan-Toyo American, Naperville, Ill.), and a 31.5% pigment vinyl chip consisting of: 30% PBL7 (pigment black #7) dispersed in a 70% vinyl copolymer resin (obtained from Penn Color Inc., Doylestown, Pa., product code 81B221), dissolved in 24.5% propylene glycol methyl ether acetate, 24.5% cyclohexanone, and 19.5% dipropylene glycol monomethyl ether acetate. The formulas were coated onto a paper liner at a thickness of about 0.4 mm. Then, ceramic optical elements (1.9 index of refraction), with an average size of approximately 0.2 mm, were flood coated onto the polyurethane. The samples were then cured in a forced air oven for about 10 minutes at about 120° C.

Various methods of manufacturing these optical elements are available such as described in Example 1 of U.S. Pat. No. 4,772,551. In that Example, 90.0 g of aqueous colloidal silica sol, while being rapidly stirred, was acidified by the addition of 0.75 ml concentrated nitric acid. The acidified colloidal silica was added to 200.0 g of rapidly stirring zirconyl acetate solution. 52.05 g of Niacet aluminum formoacetate (34.44% fired solids) were mixed in 300 ml deionized water and dissolved by heating to 80° C. This solution, when cooled, was mixed with the zirconyl acetate/silica mixture described previously. The resulting mixture was concentrated by rotoevaporation to 35% fired solids. The concentrated bead precursor solution was added dropwise to stirred, hot (88°–90° C.) peanut oil. The precursor droplets were reduced in size by the agitation of the oil and gelled.

Agitation was continued in order to suspend most of the resulting gelled droplets in the oil. After about one hour, agitation was stopped and the gelled optical elements separated by filtration. The recovered gelled optical elements were dried in an oven for 5 hours at 78° C. prior to firing. The dried optical elements were placed in a quartz dish and fired in air by raising the furnace temperature slowly to 900° C. over 10 hours, maintaining 900° C. for 1 hour, and cooling the optical elements with the furnace. The initial firing of all the samples was done a box furnace with the door slightly open.

The Coefficient of Retroreflection ($R_A$) was measured at an entrance angle of −4.0 degrees and an observation angle of 0.2 degrees. This geometry correlates with geometries representing observation distances ranging from 30 to 120 meters.

Y was measured at 0 degrees entrance angle and 45 degree observation angle. The following table summarizes the results:

TABLE 1

| Sample # | DES N-100 | TONE 301 | Aluminum Flake (Al) | Carbon Black (CB) | Vinyl Resin | Ratio Al To CB | $R_A$ Cd/Lx/m$^2$ | Y |
|---|---|---|---|---|---|---|---|---|
| 1 | 46.4% | 24.3% | 16.0% | 4.01% | 9.35% | 3.99 | 13 | 12 |
| 2 | 53.6% | 28.1% | 8.68% | 2.90% | 6.76% | 3.00 | 16 | 11 |
| 3 | 41.7% | 21.8% | 20.0% | 4.96% | 11.6% | 4.03 | 15 | 15 |
| 4 | 48.2% | 25.2% | 10.0% | 5.00% | 11.6% | 2.01 | 9.0 | 9.9 |
| 5 | 56.0% | 29.3% | 8.00% | 2.02% | 4.70% | 3.97 | 20 | 11 |
| 6 | 58.6% | 30.7% | 4.02% | 2.00% | 4.68% | 2.01 | 12 | 9.2 |
| 7 | 44.8% | 23.6% | 15.0% | 5.00% | 11.7% | 3.00 | 11 | 13 |

EXAMPLE 2

Comparative Pearlescent Samples

Polyurethane samples similar to Example 1 were prepared substituting AFFLAIR 9119 pearlescent pigment, (obtained from EM Industries Inc., New York), for the aluminum flake. Table 2 sets forth the formulations as well as $R_A$ and Y values. These samples have slightly lower Y values and nominally the same retroreflectivity values as Example 1.

TABLE 2

| Sample # | DES N-100 | TONE 301 | AFFLAIR 9119 | Carbon Black (CB) | Vinyl Resin | Ratio AFFLAIR TO CB | $R_A$ Cd/Lx/m$^2$ | Y |
|---|---|---|---|---|---|---|---|---|
| 1 | 46.4% | 24.3% | 16.0% | 4.01% | 9.35% | 3.99 | 14 | 7.2 |
| 2 | 53.6% | 28.1% | 8.68% | 2.90% | 6.76% | 3.00 | 13 | 7.0 |
| 3 | 41.7% | 21.8% | 20.0% | 4.96% | 11.6% | 4.03 | 12 | 7.4 |
| 4 | 48.2% | 25.2% | 10.0% | 5.00% | 11.6% | 2.01 | 8.0 | 6.7 |
| 5 | 56.0% | 29.3% | 8.00% | 2.02% | 4.70% | 3.97 | 17 | 6.9 |
| 6 | 58.6% | 30.7% | 4.02% | 2.00% | 4.68% | 2.01 | 16 | 6.8 |
| 7 | 44.8% | 23.5% | 15.0% | 5.00% | 11.7% | 3.00 | 10 | 6.9 |

EXAMPLE 3

Aluminum Flake Samples

Polyurethane samples similar to Example 1 were prepared using a higher percentage of Aluminum flake pigment and a range of black pigment loadings. Table 3 summarizes the Y values and $R_A$ values. These samples have significantly higher retroreflectivity values and increased Y values than the samples (Example 1) having a lower aluminum flake loading.

TABLE 3

| Sample # | DES N-100 | TONE 301 | Aluminum Flake (Al) | Carbon Black (CB) | Vinyl Resin | Ratio Al To CB | $R_A$ Cd/Lx/m$^2$ | Y |
|---|---|---|---|---|---|---|---|---|
| 1 | 42.6% | 22.3% | 35.0% | 0.00% | 0.00% | NA | 98 | 34 |
| 2 | 41.6% | 21.8% | 35.0% | 0.46% | 1.08% | 76.0 | 70 | 29 |
| 3 | 39.7% | 20.8% | 35.0% | 1.32% | 3.1% | 26.5 | 55 | 25 |
| 4 | 38.0% | 19.9% | 35.0% | 2.11% | 4.9% | 16.6 | 43 | 24 |
| 5 | 35.7% | 18.7% | 35.0% | 3.17% | 7.39% | 11.1 | 35 | 24 |
| 6 | 31.8% | 16.7% | 35.0% | 4.94% | 11.5% | 7.09 | 24 | 22 |
| 7 | 23.4% | 12.2% | 35.0% | 8.81% | 20.6% | 3.97 | 11 | 19 |
| 8 | 17.0% | 8.92% | 35.0% | 11.7% | 27.3% | 2.99 | 7.0 | 19 |

EXAMPLE 4

Pearlescent Samples

Polyurethane samples similar to Example 3 substituting AFFLAIR for Aluminum flake pigment and a range of black pigment loadings. Table 4 summarizes the results. In this Example, the retroreflectivity values are substantially increased and the Y values are equal to or lower than Example 1. With higher pearlescent pigment loading, ratios of pearl to carbon black in the range of 10 to 76 give substantially better results than Example 1.

TABLE 4

| Sample # | DES N-100 | TONE 301 | AFFLAIR 9119 | Carbon Black (CB) | Vinyl Resin | Ratio AFFLAIR To CB | $R_A$ Cd/Lx/m$^2$ | Y |
|---|---|---|---|---|---|---|---|---|
| 1 | 42.6% | 22.3% | 35.0% | 0.00% | 0.00% | NA | 72 | 52 |
| 2 | 41.6% | 21.8% | 35.0% | 0.46% | 1.08% | 76.0 | 52 | 13 |
| 3 | 39.7% | 20.8% | 35.0% | 1.32% | 3.1% | 26.5 | 39 | 10 |
| 4 | 38.0% | 19.9% | 35.0% | 2.11% | 4.9% | 16.6 | 37 | 9.0 |
| 5 | 35.7% | 18.7% | 35.0% | 3.17% | 7.39% | 11.1 | 27 | 8.5 |
| 6 | 31.8% | 16.7% | 35.0% | 4.94% | 11.5% | 7.09 | 15 | 7.9 |
| 7 | 23.4% | 12.2% | 35.0% | 8.81% | 20.6% | 3.97 | 7.0 | 2.0 |
| 8 | 17.0% | 8.92% | 35.0% | 11.7% | 27.3% | 2.99 | 5.0 | 7.2 |

EXAMPLE 5

Titanium Dioxide Samples

Polyurethane samples similar to Example 3 were prepared substituting STANTONE 10EXP03, a 60%/40% titanium dioxide dispersed in an epoxy resin (obtained from Harwick Chemical Corp., Akron, Ohio), for the aluminum flake. Table 5 sets forth the formulations as well as $R_A$ values and Y values. The results are rather surprising. Retroreflectivity similar to Example 1 with lower Y is achieved with titanium dioxide to carbon black ratios in the range of 10 to 30.

TABLE 5

| Sample # | DES N-100 | TONE 301 | $TiO_2$ | Epoxy Resin | Carbon Black (CB) | Vinyl Resin | Ratio $TiO_2$ To CB | $R_A$ Cd/Lx/m$^2$ | Y |
|---|---|---|---|---|---|---|---|---|---|
| 1 | 27.3% | 14.3% | 35.0% | 23.4% | 0.00% | 0.00% | NA | 17 | 79 |
| 2 | 26.3% | 13.8% | 35.0% | 23.4% | 0.46% | 1.06% | 76.8 | 17 | 19 |
| 3 | 24.5% | 12.8% | 35.0% | 23.4% | 1.28% | 2.98% | 27.4 | 14 | 14 |
| 4 | 22.9% | 12.0% | 35.0% | 23.4% | 1.99% | 4.64% | 17.6 | 11 | 10 |
| 5 | 20.9% | 11.0% | 35.0% | 23.4% | 2.91% | 6.78% | 12.1 | 9.0 | 8.7 |
| 6 | 17.8% | 9.33% | 35.0% | 23.4% | 4.33% | 10.1% | 8.10 | 7.0 | 7.9 |
| 7 | 11.9% | 6.24% | 35.0% | 23.4% | 7.03% | 16.4% | 4.99 | 5.0 | 7.0 |
| 8 | 8.1% | 4.26% | 35.0% | 23.4% | 8.75% | 20.4% | 4.00 | 4.0 | 6.7 |

EXAMPLE 6

Flat Pavement Marking Samples

Flat pavement marking tapes were made with a binder layer comprising the polyurethane compositions in Table 6. The urethane compositions were coated onto paper liner at a thickness of 0.25 mm. Immediately, 77 grams per square meter of 1.9 index ceramic optical elements of approximately 0.2 mm size (described in Example 1) were randomly dropped into the coating. The tapes were then cured in an oven for about 10 minutes at about 120° C. The optical elements sank into the polyurethane to embed nominally about 50%. The $R_L$ was then measured at a geometry which represents an automobile at 30 meters (88.8 degree entrance angle and 1.05 degree observation angle). Table 6 summarizes the results of $R_L$ and Y. Surprisingly, very low Y levels and good retroreflectivity can be achieved in flat pavement marking tapes. In general titanium dioxide and pearlescent pigment give better results.

TABLE 6

| Sample # | DES N-100 | TONE 301 | Aluminum Flake | AFFLAIR 9109 | $TiO_2$ | Epoxy Resin | Carbon Black (CB) | Vinyl Resin | Ratio Pigment To CB | $R_L$ 88.8/1.05 mcd/m$^2$/lx | Y |
|---|---|---|---|---|---|---|---|---|---|---|---|
| 1 | 56.0% | 29.3% | 6.98% | | | | 2.02% | 4.70% | 3.97 | 117 | 5.5 |
| 2 | 56.0% | 29.3% | | 6.98% | | | 2.02% | 4.70% | 3.97 | 71 | 3.6 |
| 3 | 35.7% | 18.7% | 35.0% | | | | 3.17% | 7.39% | 11.1 | 224 | 25 |
| 4 | 39.7% | 20.8% | | 35.0% | | | 1.32% | 3.08% | 26.5 | 339 | 14 |
| 5 | 38.0% | 19.9% | | 35.1% | | | 2.11% | 4.92% | 16.6 | 180 | 9.8 |
| 6 | 35.7% | 18.7% | | 35.0% | | | 3.17% | 7.39% | 11.1 | 115 | 7.3 |
| 7 | 24.5% | 12.8% | | | 35.0% | 23.4% | 1.28% | 2.98% | 27.5 | 488 | 16 |
| 8 | 22.9% | 12.0% | | | 35.1% | 23.4% | 1.99% | 4.64% | 17.6 | 294 | 10 |
| 9 | 0.209 | 11.1% | | | 35.0% | 23.4% | 2.91% | 6.78% | 12.1 | 232 | 8.2 |

EXAMPLE 7

Pavement marking tapes having protrusions were made as follows. A flat black pliant polymer premix used in the production of 3M SCOTCH-LANE™ Removable Black Line Mask Series 145 available from 3M. The material was heated to 120° C. and embossed at a pressure of about 600 psi (4.1 MPa) for about 3 minutes. The pattern consisted of raised cylinders with a height of about 2.5 mm and a diameter of about 8.6 mm. The cylinders were arranged about 26 mm apart in rows. Each row was separated about 19.5 mm such that the cylinders in every fourth row align in registry. Thus, cylinders were separated in the longitudinal direction by a spacing of about 59 mm. Three different polyurethane binder layers were prepared. The first contained 42.6 grams of DesN100 isocyanate, 22.4 grams of TONE 301 polyol, and 35 grams of AFFLAIR 103 pearlescent pigment (hereafter called "white" binder layer). The second binder layer was made by adding 40 grams of a 25.3% pigment vinyl chip consisting of: 50% PY110 ((pigment yellow 110) dispersed in a 50% vinyl copolymer resin (obtained from pigment dispersion Penn Color Inc., Doyleston, Pa., product code 81Y312) dissolved in 34.2% propylene glycol methyl ether acetate, 34.2% cyclohexanone, and 5.30% dipropylene glycol monomethyl ether acetate, to 100 grams of the previous urethane formula. This formula is hereafter called "yellow" binder layer. A "black" binder layer was made by adding 15 grams of 3M SCOTCHLITE™ Transparent Screen Printing Ink Series 905, available from 3M, to 100 grams of the "white" binder layer (hereafter called "black" binder layer). Each urethane composition was coated onto a release liner at a thickness of about 0.5 mm using a notch bar. A 4 inch by 6 inch (10 cm by 15 cm) piece of black embossed premix was inverted and pressed into the urethane, and then peeled out. Colorless 1.93 index of refraction ceramic optical elements (as described in Example 1) were embedded into the "white" binder layer. Yellow tinted ceramic optical elements were embedded into the "yellow" binder layer. Colorless and yellow ceramic optical elements were embedded into the "black" binder layer. The $R_L$ was measured in both directions on the samples at entrance/observation angles of 86.0/0.2, 86.0/0.5, and 86.5/1.0.

Using the pattern orientation of this example, measurements of $R_L$ at these geometries correlates very well with $R_L$ measurements at geometries which approximate distances of 30 to 120 meters (88.8/1.05 to 89.7/0.26).

As noted previously, with measurements of $R_A$ at specific geometries, measurements of $R_L$ at these entrance and observations angles can also be correlated with retroreflection performance measures at approximate driver geometries within a given family of pavement marking constructions or articles. Table 7 summarizes the results.

TABLE 7

| | Coefficient of retroreflected luminance ($R_L$) in mcd/m$^2$/lx | | | |
|---|---|---|---|---|
| Entrance/Observation Angle | "white" binder layer with colorless optical elements | "yellow" binder layer with yellow optical elements | "black" binder layer with colorless optical elements | "black" binder layer with yellow optical elements |
| 86.0/0.2 | 16,500 | 22,000 | 20,200 | 19,000 |
| 86.0/0.5 | 8,200 | 8,400 | 7,700 | 7,600 |
| 86.5/1.0 | 1,680 | 1,280 | 1,700 | 900 |

EXAMPLE 8

A black polyurethane was prepared according to Example 4, Sample #3. The polyurethane was coated onto a release liner at a thickness of 0.5 mm using a notch bar.

A conformable magnetic article of the invention was made by compounding the following in a Banbury-type internal mixer to thoroughly mix the ingredients.

| Material | Spec. Grav. | Parts | Description | Available From |
|---|---|---|---|---|
| Paracril ™ B | 0.98 | 100.0 | medium acrylonitrile content nitrile rubber | Uniroyal Chemical Co., Akron, Ohio |
| Chlorez ™ 700S | 1.66 | 70.0 | solid chlorinated paraffin | Dover Chemical Corp., Dover, Ohio |
| Paroil 140 LV | 1.16 | 5.0 | a liquid chlorinated paraffin | Dover Chemical Corp., Dover, Ohio |
| Stearic Acid | 0.84 | 0.5 | process aid | Humko Chemical Division of Witco Chemical Corp., Memphis, Tennessee |
| Vanstay ™ SC | 0.89 | 0.5 | "chelating agent" type stabilizer | R. T. Vanderbilt Company, Inc., Norwalk, Conneoticut |
| Santowhite ™ Crystals | 1.07 | 1.0 | antioxidant | Monsanto Chemical Co., St. Louis, Missouri |
| PE Minifiber 13038F | 0.94 | 20.0 | high density polyethylene fiber | Mini Fibers, Inc., Johnson City, Tennessee |
| PET 6-3025 fibers | 1.38 | 10.0 | ¼" × 3d. polyester fiber | Mini-Fibers, Inc., Johnson City, Tennessee |
| Barium hexaferrite P-235 | 5.3 | 950.0 | magnetic pigment | Arnold Engineering Co., Norfolk, Nebraska |
| Total Weight | | 1157 | | |

When the temperature of the mix reached 146° C. the mix was dropped from the mixer onto a two roll rubber mill. The material was sheeted off the rubber mill and fed through a two-roll calender to yield a sheet of material having a thickness of approximately 1.4 mm.

The sheet of material was embossed according to the process described in U.S. Pat. No. 5,227,221 (col. 2, lines 47–65) to provide a conformable magnetic sheet having a plurality of protrusions projecting from one of its major surfaces. The embossed sheet had a thickness of about 0.5 mm in the valleys between the protrusions, and a thickness of about 1.6 mm at the protrusions.

The sheet was then laminated protrusion side into the urethane film. A hand roller was used to press the protrusion into the urethane. The pavement marking was then peeled out of the urethane. Immediately, the sample was flood coated with colorless optical elements (a 1.9 index glass optical element with a hemispherical vapor coat as described in U.S. Pat. No. 2,963,378).

These optical elements can be made using one of the following methods. One way is to use a high-vacuum metal vapor deposition procedure. A carrier web having a non-volatile plastic tacky surface (such as a plasticized resin layer) is coated with a layer of 1.9 index of refraction glass spheres of the desired size which are partially pressed in, the excess being brushed off to leave a mono-layer adhering to and partially embedded in the carrier surface. One way to do this is to pass the web, sphere side down, through a region of a high-vacuum chamber where it is subjected to a vapor that condenses on the lower halves of the spheres, the vapor being produced from a material that is located beneath the web and is suitably heated. Cryolite (sodium aluminum fluoride) is a preferred example. The thickness of the coating is determined by the length of exposure time. The carrier web, sphere side down, is then passed through a region of high-vacuum chamber where it is subjected to aluminum vapor arising from a source located therebeneath, the exposure time being sufficient to deposit a thin opaque reflective coating of metallic aluminum on the lower half of each sphere, this deposition being upon the spacing coating if such has been provided. The reflectorized particles are subsequently removed from the carrier sheet by means of a rotary wire brush.

A second sheet was laminated with the urethane and flood coated with yellow optical elements with a hemispherical vapor coat. The urethane coated sample was cured in an oven at approximately 120° C. for about 15 minutes. Any excess optical elements were brushed off the sample after cooling.

The sample was substantially black when viewed in daylight and retroreflected a brilliant white or yellow color when illuminated with a flashlight (depending on the optical element color). The Coefficient of Retroreflected Luminance ($R_L$) was measured as follows:

| Optical Element Color | $R_L$ at 86.0/0.2 (mcd/m$^2$/lx) | $R_L$ at 86.5/1.0 (mcd/m$^2$/lx) |
|---|---|---|
| white vapor coated optical elements | 8500 | 1900 |
| yellow vapor coated optical elements | 11400 | 2500 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A pavement marking article comprising a top surface having one or more first region(s) comprising at least a light-reflecting system and a black pigment in a ratio of at least about 7:1 wherein:

said first region(s) has a daytime appearance of black; and said first region(s) is retroreflective.

2. The pavement marking article according to claim 1, further comprising one or more second region(s) wherein:

said first region(s) is adjacent to said second region(s) and said second region(s) has a color which contrasts with black.

3. The pavement marking article according to claim 1, wherein said first region(s) comprises a binder layer.

4. The pavement marking article according to claim 3, wherein said binder layer comprises black pigment.

5. The pavement marking article according to claim 4, wherein said black pigment is carbon black.

6. The pavement marking article according to claim 4, wherein optical elements are partially embedded in said binder layer.

7. The pavement marking article according to claim 6, wherein said optical elements are selected from the group consisting of yellow optical elements, colorless optical elements, and mixtures thereof.

8. The pavement marking article according to claim 6, wherein said light-reflecting system is selected from the group consisting of pearlescent pigment, titanium dioxide, zinc oxide, zinc sulfide, lithophone, zirconium silicate, zirconium oxide, natural and synthetic barium sulfates, and mixtures thereof.

9. The pavement marking article according to claim 8, wherein said light-reflecting system to black pigment ratio ranges from about 7:1 to about 80:1.

10. The pavement marking article according to claim 6, wherein said optical elements are vapor coated.

11. The pavement marking article according to claim 6, wherein said binder layer is directly applied to a traffic-bearing surface.

12. The pavement marking article according to claim 6, wherein said article is a retroreflective element.

13. The pavement marking article according to claim 12, wherein said retroreflective element is partially embedded in a road-binder.

14. The pavement marking article according to claim 6, wherein said binder layer forms the top layer of a pavement marking tape.

15. The pavement marking article according to claim 14, wherein said pavement marking tape has protrusions.

16. The pavement marking article according to claim 14, wherein said pavement marking tape is substantially flat.

17. The pavement marking article according to claim 14, wherein said pavement marking tape is removable.

18. The pavement marking article according to claim 14, wherein said pavement marking tape is magnetic.

19. The pavement marking article according to claim 2, wherein said second region(s) is oriented longitudinally or laterally adjacent to said first region.

20. The pavement marking article according to claim 2, wherein said second region is oriented such that said second region alternates with said first region.

21. The pavement marking article according to claim 2, wherein said second region(s) comprises a binder layer.

22. The pavement marking article according to claim 21, wherein said binder layer comprises a color selected from the group consisting of yellow, white, orange, fluorescents and mixtures thereof.

23. The pavement marking article according to claim 22, further comprising optical elements partially embedded in said binder layer in said second region(s).

24. The pavement marking article according to claim 23, wherein said optical elements are selected from the group consisting of yellow optical elements, colorless optical elements, and mixtures thereof.

25. The pavement marking article according to claim 4, wherein said black pigment has a Y value of about 20 or less.

26. The pavement marking article according to claim 4, wherein said black pigment has a coefficient of reflectance greater or equal to about 150 $mcd/m^2/lux$ at 88.76° entrance angle and 1.05° observation angle.

27. The pavement marking article according to claim 4, wherein said black pigment ranges in size from about 0.01 micron to about 0.08 micron.

28. The pavement marking article according to claim 4, wherein said black pigment is present at a concentration of at least about 1 weight percent based on the total weight of the binder layer material.

* * * * *